US005328525A

United States Patent [19]

Musingo et al.

[11] Patent Number: 5,328,525

[45] Date of Patent: Jul. 12, 1994

[54] METHOD AND COMPOSITION FOR TREATMENT OF METALS

[75] Inventors: Edward M. Musingo, Roslyn; Bruce V. Haberle, Fogelsville; Philip D. Deck, Ardsley, all of Pa.

[73] Assignee: Betz Laboratories, Inc., Trevose, Pa.

[21] Appl. No.: 765

[22] Filed: Jan. 5, 1993

[51] Int. Cl.[5] ..... C23C 22/44

[52] U.S. Cl. ..... 148/247; 148/251

[58] Field of Search ..... 148/251, 247

[56] References Cited

U.S. PATENT DOCUMENTS

| | | | |
|---|---|---|---|
| 3,468,724 | 9/1969 | Reinhold | 148/6.15 |
| 3,682,713 | 8/1972 | Ries et al. | 148/6.14 R |
| 4,136,073 | 1/1979 | Muro et al. | 260/29.2 EP |
| 4,191,596 | 6/1990 | Dollman et al. | 148/247 |
| 4,273,592 | 6/1981 | Kelly | 148/6.27 |
| 4,294,627 | 10/1981 | Heyes | 148/6.14 R |
| 4,370,177 | 1/1983 | Frelin et al. | 148/6.27 |
| 4,422,886 | 12/1983 | Das et al. | 148/31.5 |
| 4,921,552 | 5/1990 | Sander et al. | 14.8/247 |
| 5,143,562 | 9/1992 | Boulos | 148/247 |

FOREIGN PATENT DOCUMENTS

| | | | |
|---|---|---|---|
| 1803878 | 5/1969 | Fed. Rep. of Germany | 148/251 |
| WO8505131 | 11/1985 | PCT Int'l Appl. . | |
| 1041347 | 9/1966 | United Kingdom | 148/251 |

*Primary Examiner*—Sam Silverberg

*Attorney, Agent, or Firm*—Alexander D. Ricci; Steven D. Boyd

[57] ABSTRACT

A non-chromate pretreatment for aluminum and zinc-aluminum galvanized steel is disclosed which comprises a polyacrylic acid or homopolymers and copolymers thereof, a molybdate, and a dihydrohexafluo acid.

6 Claims, No Drawings

METHOD AND COMPOSITION FOR TREATMENT OF METALS

FIELD OF THE INVENTION

The present invention relates generally to non-chromate coatings for metals. More particularly, the present invention relates to a non-chromate coating for aluminum and Galvalume (a trademark of Bethlehem Steel for zinc - aluminum galvanized steel) which improves the adhesion of siccative coatings to the surface. The present invention provides a dried in place coating which is particularly effective at treating aluminum to be formed.

BACKROUND OF THE INVENTION

The purposes of the formation of a chromate conversion coating on the surface of metals are to provide corrosion resistance, improve adhesion of coatings and for aesthetic reasons. The conversion coating improves adhesion of coating layers such as paints, inks, lacquers and plastic coating. A chromate conversion coating is typically provided by contacting metals with an aqueous composition containing hexavalent or trivalent chromium ions, phosphate ions and fluoride ions. Growing concerns exist regarding the pollution effects of the chromates and phosphates discharged into rivers and waterways by such processes. Because of high solubility and the strongly oxidizing character of hexavalent chromium ions, conventional chromate conversion processes require extensive waste treatment procedures to control their discharge. In addition, the disposal of the solid sludge from such waste treatment procedures is a significant problem.

Chromate free pre-treatment coatings based upon complex fluoacids and salts and metals such as cobalt and nickel are known in the art. U.S. Pat. No. 3,468,724 which issued to Reinhold discloses a composition for coating ferriferous and zinc metal which comprises a metal such as nickel or cobalt and an acid anion selected from the group sulfate, chloride, sulfamate, citrate, lactate, acetate and glycolate at a pH from 0.1 to 4.

While chromate free pretreatment coatings based upon complex fluoacids and polyacrylic acids are known in the art, they have not enjoyed widespread commercial acceptance. U.S. Pat. No. 4,191,596 which issued to Dollman et al, discloses a composition for coating aluminum which comprises a polyacrylic acid and $H_2ZrF_6$, $H_2TiF_6$ or $H_2SiF_6$. The '596 disclosure is limited to a water soluble polyacrylic acid or water dispersible emulsions of polyacrylic acid esters in combination with the described metal acids at a pH of less than about 3.5.

PCT Publication No. WO 85/05131 discloses an acidic aqueous solution to be applied to galvanized metals which contains from 0.1 to 10 grams/liter of a fluoride containing compound and from 0.015 to 6 grams/liter of a salt of cobalt, copper, iron, magnesium, nickel, strontium or zinc. Optionally, a sequesterant and a polymer of methacrylic acid or esters thereof can be present.

U.S. Pat. No. 4,921,552 which issued to Sander et. al. discloses a non-chromate coating for aluminum which is dried in place and which forms a coating having a gravimetric weight of from about 6 to 25 milligrams per square foot. The aqueous coating composition consists essentially of more than 8 grams per liter dihydro-hexafluozirconic acid, more than 10 grams per liter of water soluble acrylic acid and homopolymers thereof, and more than 0.17 grams per liter hydrofluoric acid.

A process for applying a protective coating to aluminum, zinc and iron is disclosed in U.S. Pat. No. 3,682,713 to Ries et al. The coating consists essentially of from 0.1 to 15 grams per liter of complex fluorides of boron, titanium, zirconium and iron, from 0.1 to 10 grams per liter of free fluoride ions and from 0.5 to 30 grams per liter an oxidizing agent such as sodium N-nitrobenzene sulfomate. The solution has a pH of from 3.0 to 6.8 and is free of phosphoric acid, oxalic acid and chromic acid.

U.S. Pat. No. 4,136,073 which issued to Muro et al., discloses a composition and process for the pretreatment of aluminum surfaces using an aqueous acidic bath containing a stable organic film forming polymer and a soluble titanium compound. The disclosed polymers include vinyl polymers and copolymers derived from monomers such as vinyl acetate, vinylidene chloride, vinyl chloride, acrylic polymers derived from monomers such as acrylic acid, methacrylic acid, acrylic esters, methacrylic esters and the like; amino alkyl, epoxy, urethane-polyester, styrene and olifinic polymers and copolymers; and natural and synthetic rubbers.

SUMMARY OF THE INVENTION

The present invention provides a composition for and method of treating the surface of metals to provide for the formation of a coating which increases the adhesion properties of the metal surface. The coating formed by the present invention may be dried in place or rinsed. The composition of the present invention comprises: (a) a dihydro-hexafluorozirconic or dihydro-hexafluortitanic acid such as fluozirconic acid or fluotitanic acid, (b) a water soluble polymer selected from acrylic acid and homopolymers and copolymers thereof, and (c) a molybdate such as ammonium molybdate.

The invention also provides a method forming a dried in place conversion coating on a metal surface with an aqueous solution. The coating formed by the method of the present invention is effective at improving the adhesion properties of metals such as aluminum and Galvalume.

DETAILED DESCRIPTION OF THE PREFERRED EMBODIMENTS

The present inventors have discovered that an improved coating on articles of Galvalume or aluminum or alloys thereof can be formed by an aqueous coating solutions comprising a water soluble polymer selected from acrylic acid and homopolymers and copolymers thereof, a dihydro-hexafluozirconic acid or dihydro-hexafluotitanic acid and a molybdate. The combination was found to provide an aqueous pretreatment agent for the treatment of aluminum and Galvalume which provides for an improved adhesion of later applied coatings when the treatment is dried in place. The treatment of the present invention can optionally be rinsed after application as by a water bath or shower.

Useful polymers within the scope of the present invention include water soluble as well as water dispersible polymers. Preferrably, the polymer is a homopolymer of acrylic acid and it is believed that water soluble copolymers of acrylic acid will also be effective. In the preferred embodiment, the polymer is polyacrylic acid having a molecular weight of about 5,000 to about 500,000. The polymer comprises from about 10 to 60 weight percent of the aqueous acidic composition of the present invention.

The aqueous acidic composition of the present invention also includes a dihydro-hexafluozirconic or dihydro-hexafluotitanic acid. It is believed that fluosilicic acids would be similarly effective. The fluozirconic or fluotitanic acid comprises from about 10 to 60 weight percent of the aqueous acidic composition of the present invention.

The aqueous acidic composition of the present invention also includes a molybdate such as ammonium molybdate. The molybdate comprises from about 0.2 to 20 weight percent of the aqueous acidic composition of the present invention.

The composition of the present invention provides an effective dried in place conversion coating solution. The composition is preferably supplied as a concentrate to be diluted for use. The concentrate may comprise from about 10 to 60% by weight the fluozirconic or fluotitanic acid component, from about 0.2 to 20% by weight the molybdate component, and from about 10 to about 60% by weight the polyacrylic acid component and the balance water. The concentrated solution may be diluted to from about 1 to 50% by volume in water prior to use. The pH of the resulting dilution is about pH 2. The pH of the dilution may be adjusted upward by the addition of an alkali such as ammonium hydroxide. Application of the composition to a metal surface may be through any conventional process including spray, immersion and roll coating.

The effectiveness of the composition and method of the present invention is demonstrated by the following examples. In these examples, the effectiveness was evaluated with a variety of adhesion tests familiar to those skilled in the art. Lacquered metal performance was evaluated by: gathering adhesion data after 15 minutes exposure to boiling Dowfax 2A1 surfactant (available from Dow Chemical Co.); delamination tests after two hours autoclave (15 psi and 115° C.) exposure to 1% lactic acids; and blistering resistance after a 24 hour exposure to 0.5% hydrochloric acid at 65° C. These tests are rated on a 0 to 10 scale.

Table 1 summarizes the treatments tested in the examples.

TABLE 1

| Treatment | Description |
|---|---|
| A | dihydro-hexafluozirconic acid |
| B | dihydro-hexafluozirconic acids + soluble copolymers of acrylic acid |
| C | Composition of Present Invention (5% dilution) |
| D | Composition of Present Invention (pH 4, 5% dilution) |
| E | dihydro-hexafluozirconic acids + soluble copolymers of acrylic acid (tannin modified) |
| F | dihydro-hexafluozirconic acids + soluble copolymers of acrylic acid (pH 2.9) |
| G | dihydro-hexafluozirconic acids + soluble copolymers of acrylic acid (pH 2.9 post rinse) |
| H | dihydro-hexafluozirconic acid/phosphate/post rinsed |
| I | dihydro-hexafluotitanic acid/tannin/phosphate and rinsed |
| J | chromium chromate (fluoride activated) post rinsed |
| K | complex oxide post rinsed |
| L | chromium phosphate (fluoride activated) post rinsed |

EXAMPLE 1

Aluminum alloy 5182 was cleaned with Betz DC-1675, a commercial alkaline cleaner available from Betz Laboratories, Inc., Trevose, Pa. Cleaning was followed by spray application of a variety of non-chromate treatments to the aluminum test panels. The applied solutions were allowed to dry in place. The treated test panels were coated with Dexter 8800A04M, a can end lacquer available from The Dexter Corporation. Table 2 summarizes the adhesion results.

TABLE 2

| Treatment | Feathering | Lactic Acid | HCl |
|---|---|---|---|
| A | 9.9 | 0 | 10.0 |
| B | 9.9 | 0 | 3.0 |
| C | 9.9 | 8.0 | 10.0 |
| D | 9.9 | 1.0 | 10.0 |

EXAMPLE 2

Aluminum alloy 5052 was cleaned with Betz DC-1675 a commercial alkaline cleaner available from Betz Laboratories, Inc. Cleaning was followed by spray application of a variety of non-chrome treatments. The applied solutions were allowed to dry in place. The treated test panels were coated with a pigmented lacquer available from Valspar of Pittsburgh, Pa. Table 3 summarizes the adhesion test results.

TABLE 3

| Treatment | Lactic Acid | HCl |
|---|---|---|
| A | 10.0 | 8.0 |
| B | 10.0 | 8.0 |
| C | 10.0 | 10.0 |
| D | 10.0 | 10.0 |

EXAMPLE 3

Aluminum alloy 5182 was alkaline cleaned with Betz DC-1675 and treated by spray application of a variety of non-chrome treatments. The applied solutions were allowed to dry in place. The treated test panels were coated with Valspar 9835 a can end lacquer. In addition to the tests described above, the lacquered metal was formed into can lids and exposed to Diet Coke, Sprite, and beer for 30 days. This pack test evaluates lacquered metal under true beverage exposure conditions. After exposure, the lids were removed from the can bodies and inspected for blistering and adhesion loss. Table 4 summarizes the adhesion test results.

TABLE 4

| Treatment | Feathering | Lactic Acid | HCl | Pack Test |
|---|---|---|---|---|
| E | 6.6 | 8.0 | — | 2 |
| F | 5.8 | 0.0 | — | 2 |
| G | 9.0 | 0.0 | — | 0 |
| H | 9.5 | 9.5 | 10.0 | 6 |
| I | 9.8 | 9.5 | 5.5 | 4 |
| C | 9.9 | 10.0 | 7.5 | 8 |
| D | 10.0 | 9.5 | 7.5 | 2 |
| L | 9.8 | 7.5 | 10.0 | 10 |

EXAMPLE 4

The aluminum loading effect of treatment D was evaluated by processing over 700 square feet of aluminum alloy 5182 in 8 liters of treatment D on an aluminum foil line. Metal samples were taken at selected intervals and the aluminun content of the treatment solution was also measured. The metal samples were coated with Valspar Universal Lacquer 9835. The coated samples were evaluated as described above. Table 5 summarizes the test results.

TABLE 5

| Aluminum | | | | |
|---|---|---|---|---|
| $Ft^2$ Treated | PPM in bath | Feathering | Lactic Acid | HCl |
| 0 | 66 | 9.9 | 9.5 | 10.0 |
| 100 | 80 | 9.8 | 9.5 | 7.0 |
| 233 | 133 | 9.8 | 9.5 | 8.0 |
| 411 | 185 | 9.7 | 9.5 | 8.0 |
| 605 | 206 | 9.5 | 10.0 | 6.0 |
| 777 | 219 | 9.9 | 10.0 | 7.0 |

EXAMPLE 5

The treatment of the present invention was also tested as a treatment for Galvalume. Chrome passivated Bethlehem Steel Galvalume was cleaned with a commercial alkaline cleaner (Betz Kleen 4004 available from Betz Laboratories, Inc., Trevose, Pa.). The alkaline cleaning was both with and without brushing. The cleaned test panels were treated with a variety of chrome treatments which were dried in place. For comparison purposes, several cleaned test panels were treated with a conventional chromate treatment (Treatment J) and chrome sealed with a dilute chromium solution. All of the treated panels were painted with an epoxy primer (Dexter 9X447) and top coated with a silicanized polyester paint (Dexter 79X3135). Performance was rated by T-bend, cross-hatch reverse impact (60 inch pounds) adhesion and neutral salt fog (ASTM B117). Table 6 summarizes the test results.

TABLE 6

| | | | Neutral Salt | |
|---|---|---|---|---|
| Treatment | T-Bend | X-Hatch | Scribe | Field |
| J no brushing | 2 | 3B | 10 | 10 |
| K no brushing | 2 | 3B | 9 | 10 |
| C no brushing | 2 | 3B | 9 | 10 |
| C no brushing | 2 | 3B | 9 | 10 |
| J with brushing | 2 | 3B | 10 | 10 |
| K with brushing | 2 | 3B | 10 | 10 |
| C with brushing | 2 | 3B | 10 | 10 |
| C with brushing | 2 | 2B | 9 | 10 |

The above examples show that the treatment composition of the present invention is more effective than known non-chrome pretreatments on aluminum and nearly matches known chrome pretreatments on aluminum. On Galvalume, the treatment composition of the present invention is as effective as known chrome pretreatments.

While the present invention has been described with respect to particular embodiments thereof, it is apparent that numerous other forms and modifications of the invention will be obvious to those skilled in the art. The appended claims and this invention generally should be construed to cover all such obvious forms and modifications which are within the true spirit and scope of the present invention.

We claim:

1. An aqueous acidic solution which is effective in forming a dried in place non chromate conversion coating on a surface of Galvalume aluminum or alloys thereof consisting essentially of:

(a) From about 10 to 60% by weight of a polymer selected from the group consisting of polyacrylic acid and copolymers and homopolymers thereof;

(b) From about 0.2 to 20 weight percent molybdate and (c) From about 10 to 60% by weight dihydro-hexafluo acid.

2. The solution of claim 1 diluted in water to from about 1 to 50% by volume.

3. The solution of claim 1 wherein said dihydro-hexafluo acid is selected from the group consisting of dihydro-hexfluozirconic acid and dihydro-hexafluotitanic acid.

4. A method of forming a conversion coating on a surface of Galvalume aluminum or alloys thereof comprising reacting the surface with an aqueous, acidic solution consisting essentially of:

(a) From about 10 to 60% by weight of a polymer selected from the group consisting of polyacrylic acid and homopolymers and copolymers thereof;

(b) From about 0.2 to 20% by weight molybdate and (c) From about 10 to 60% by weight dihydro-hexafluo acid.

5. The method of claim 4 wherein said solution is diluted to from about 1 to 50% by volume in water.

6. The method of claim 4 wherein said dihydro-hexafluo acid is selected from the group consisting of dihydro-hexafluozirconic acid and dihydro-hexafluotitanic acid.

* * * * *